US006523204B1

(12) United States Patent
Maziere et al.

(10) Patent No.: US 6,523,204 B1
(45) Date of Patent: Feb. 25, 2003

(54) METHOD OF CHECKING THE ASEPTIC NATURE OF WASHING BEFORE OPENING AT LEAST ONE DOOR OF A WASHING MACHINE

(75) Inventors: André Maziere, St Parres les Landes (FR); William Drot, Cormost (FR)

(73) Assignee: Electrolux Systems de Blanchisserie, Paris (FR)

( * ) Notice: Subject to any disclaimer, the term of this patent is extended or adjusted under 35 U.S.C. 154(b) by 194 days.

(21) Appl. No.: 09/694,219

(22) Filed: Oct. 23, 2000

(30) Foreign Application Priority Data

Oct. 27, 1999 (FR) ..... 99 13417

(51) Int. Cl.[7] ..... B08B 3/04

(52) U.S. Cl. ..... 8/158; 8/159; 68/12.02; 68/12.12; 134/113

(58) Field of Search ..... 8/158, 159; 68/12.02, 68/12.03, 12.12, 12.18, 12.19; 134/113

(56) References Cited

U.S. PATENT DOCUMENTS 3,595,252 A * 7/1971 Conte
3,896,827 A * 7/1975 Robinson
4,067,691 A * 1/1978 McGady et al.
4,509,543 A * 4/1985 Livingston et al.
4,711,851 A * 12/1987 McNamara et al.
5,095,925 A * 3/1992 Elledge et al.
5,246,023 A * 9/1993 Breunsbach et al.
5,525,514 A * 6/1996 Jacobs et al.
5,634,501 A * 6/1997 Walshe
5,706,842 A * 1/1998 Caimi et al.
5,730,806 A * 3/1998 Caimi et al.
5,911,951 A * 6/1999 Girardot et al.
5,940,915 A * 8/1999 Nam
6,016,820 A * 1/2000 Knoll et al.

FOREIGN PATENT DOCUMENTS

| | | |
|---|---|---|
| DE | 3406919 | 9/1985 |
| EP | 0 666 358 | 8/1995 |
| FR | 1435391 | 6/1966 |

* cited by examiner

*Primary Examiner*—Frankie L. Stinson
(74) *Attorney, Agent, or Firm*—Pearne & Gordon LLP

(57) ABSTRACT

Method of checking the aseptic nature of washing before opening at least one door of the washing machine.

A washing machine (10) is fitted with at least one door (14) capable of being opened into a clean room (20) at the end of each washing-rinsing-spin drying cycle. So as to avoid this opening operation being performed if the conditions for asepsis of the washing are not ensured, opening is conditional on an opening authorization signal being emitted by a control unit (36). This unit checks, successively, the introduction of water into the tank (22) of the machine, the presence in the tank of detergent products, heating of the water to a minimum temperature and the maintainence of this temperature for a predetermined time interval. If any one of these conditions is not fulfilled, the automatic opening signal is not emitted.

8 Claims, 1 Drawing Sheet

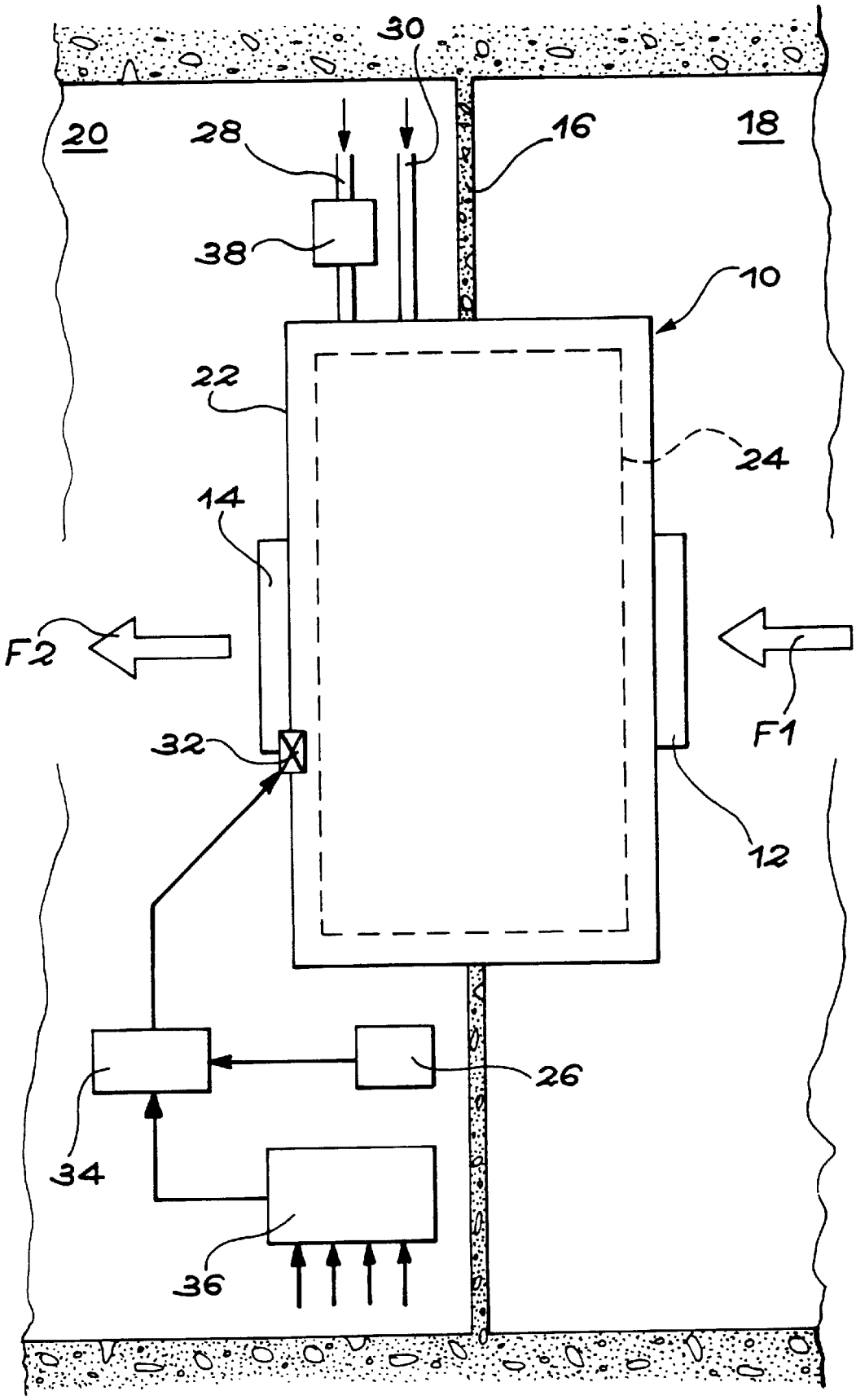
30
20
28
16
18
38
10
22
24
14
F2
F1
32
12
26
34
36

METHOD OF CHECKING THE ASEPTIC NATURE OF WASHING BEFORE OPENING AT LEAST ONE DOOR OF A WASHING MACHINE

TECHNOLOGICAL FIELD

The invention relates to a method designed to check the aseptic nature of washing contained in a washing machine, prior to the opening of at least one door of this machine that opens into a clean room.

The invention is particularly applicable to washing machines used in industrial or semi-industrial laundries which process washing coming from hospital premises. Such machines are generally fitted with at least one door opening into a contaminated room which is used to load the dirty washing into the machine and at least one door opening into a clean room and used to unload the washing when the washing is finished. In a more general way, the invention may nevertheless be applied to other types of washing machines and notably to machines fitted with a single door, when such machines are used in such a way that the washing is unloaded into a clean room.

STATE OF THE TECHNOLOGY

In industrial laundries intended for the treatment of washing from hospital premises, the washing is generally washed in washing machines integrated into a partition separating a contaminated room from a clean room. The machine then comprises at least one door opening into the contaminated room and used for loading the dirty washing and at least one door opening into the clean room and used to unload the washed laundry.

In a laundry of this type, the opening of the door or doors of the machine opening into the clean room is generally commanded by an opening order supplied by a controller which operates the machine when the washing-rinsing-spin drying cycle is finished.

In most cases, the washing which is taken out of the machine into the clean room effectively provides the desired conditions of hygiene and asepsis due to the carrying out of the washing-rinsing-spin drying cycle commanded by the controller.

However, it may happen that the cycle effectively carried out by the machine is defective and does not enable one to guarantee the total destruction of pathogenic bacteria present in the washing. For example, the troughs containing detergent products may be empty or the heating system of the machine may be broken down. The washing-rinsing-spin drying cycle is then commanded normally by the controller and an order for the opening of the door or doors opening into the clean room is given at the end of the cycle.

In existing washing machines, the door or doors opening into the clean room can therefore be opened when the required conditions of asepsis of the washing have not been achieved. Considering the dangers presented by certain pathogenic bacteria which are to be found in washing coming from hospital premises, it is highly desirable to have washing machines available in which this risk is totally eliminated.

DESCRIPTION OF THE INVENTION

The precise subject of the invention is a method that makes possible the checking of the aseptic nature of the washing before opening the door or the doors of washing machine opening into a clean room, so that his opening is not authorized when it is not certain hat the conditions of asepsis of the washing have been achieved.

Conforming to the invention, this result is obtained by means of a method of checking the aseptic nature of the washing prior to the opening of at least one door of a washing machine, characterized in that it comprises, the following successive steps in this order:

- checking the arrival of a minimum quantity of water in the tank of the machine;
- checking the presence of detergent products in said tank;
- verifying that a minimum temperature is achieved by the water contained in said tank;
- emission of a signal authorizing the opening of said door, a predetermined interval of time after obtaining said minimum temperature in said tank.

By enabling one to ensure that the washing water and then the detergent products have been properly introduced into the tank of the machine and by afterwards checking that the water bath thereby obtained has been properly heated to the desired temperature for a minimum time interval, the method according to the invention guarantees total destruction of the pathogenic bacteria initially present in the washing. Since authorization to open the door is only given when these various checks have been carried out, it then becomes possible to guarantee perfect hygiene of the washing when the door of the washing machine is opened.

According to an improvement in the invention, checking the arrival of said minimum quantity of water is followed by a check on the rotation of the drum of the machine. It is then certain that the mixing of the water bath made up of the mixture of water and detergent products has been ensured.

According to one preferred embodiment of the invention, the washing machine is integrated into a sealed partition separating a contaminated room from a clean room and it has at least one door opening into each of these rooms. Each door opening into the clean room is then locked, in the closed state, until the emission of the signal authorizing opening.

So as to check the arrival of the minimum quantity of water in the tank of the machine, the flow rate, volume or mass of the water admitted to the tank may be measured or the height of the water in the tank may be measured.

In addition, the check on the presence of the detergent products can be provided either by measuring the pH of the water bath contained in the tank, or by measuring the total hardness of this water bath or by checking the arrival of the detergent products in the tank.

When the check of the presence of the detergent products is provided by a pH measurement, one may advantageously verify that the pH of the bath is at least equal to about 9.

In the preferred embodiment of the invention, it is verified that the water bath achieves a minimum temperature of at least about 60° C. In addition, the signal for opening the door is emitted advantageously 20 minutes after this minimum temperature has been reached.

BRIEF DESCRIPTION OF THE DRAWINGS

By way of a non-limitative example, a preferred embodiment of the invention will now be described making reference to the appended drawing, in which the single FIGURE diagrammatically represents a washing machine integrated into a partition separating a contaminated room from a clean room, said machine being fitted with a device for checking the aseptic nature of the washing, employing the method of the invention.

DETAILED DESCRIPTION OF A PREFERRED EMBODIMENT OF THE INVENTION

The checking method according to the invention is applicable to a washing machine fitted with at least one door capable of opening into a clean room when the washing is finished. In the preferred embodiment of the invention illustrated in the single figure, the washing machine, designated in general fashion by reference number 10, is a large capacity machine fitted with a loading door 12, through which the dirty washing is put into the machine, and an unloading door 14 through which the clean washing is taken out of the machine. The number of doors 12 and 14 may nevertheless be different, without departing from the scope of the invention.

The washing machine 10 is integrated into a sealed partition 16, separating a contaminated room 18 from a clean room 20. The door 12 opens into the contaminated room 18, while the door 14 opens into the clean room 20.

This arrangement which is commonly found in laundries intended for laundering washing coming from hospital premises, enables the dirty washing to be put into the machine 10 through the door 12 and the clean washing to be taken out into the clean room 20 through the door 14. The arrows Fl and F2 respectively symbolize the loading of the dirty washing through the door 12 and the unloading of the clean washing through the door 14.

In a traditional way, the washing machine 10 comprises a fixed tank 22 and a perforated drum 24 capable of turning inside the tank 22, in either direction, under the action of a motor (not represented).

So as to command the carrying out of a complete washing-rinsing-spin drying cycle, the machine 10 is fitted with a programmable controller 26 which controls the different functions necessary for the carrying out of the cycle (injection of water and the detergent products, rotation of the drum, discharge, etc.).

In the single FIGURE, a pipe 28 for injecting water into the tank 22 is also shown together with a pipe 30 for injecting detergent products into said tank. A mechanism 32 for locking the unloading door 14 has also been shown, this door 14 opening into the clean room 20. This locking mechanism 32 is normally in the locked condition as long as an unlocking command has not been sent by the programmable controller 26, at the end of the washing-rinsing-spin drying cycle. This unlocking command is carried out by an unlocking command system 34 connected to the locking mechanism 32.

Conforming to the invention, this unlocking command can only be executed by the unlocking command system 34 under the condition that a signal authorizing the opening of the door 14 has been previously delivered by a control unit 36.

In a more precise way, the control unit 36 is connected to a certain number of detectors so as to sequentially check that a certain number of conditions have been met, conditions that are indispensable to the destruction of the pathogenic bacteria that might have been present in the washing previously loaded into the machine.

Chronologically, the first check carried out by the control unit 36 consists of checking the arrival of a minimum quantity of water in the tank 22 of the machine 10. In other words, a check is made that the tank 22 is correctly filled with water before the drum 24 begins to turn and before the detergent products are injected into the tank.

When a satisfactory quantity of water has been injected into the tank, the control unit 36 proceeds to the next check. On the other hand, if water is not injected into the tank or if an insufficient quantity is injected, the following check is not carried out and authorization to open the door 14 will never be given. In this case, advantageously, a display and/or an alarm are activated to inform personnel of the existence of an anomaly. The same effects are obtained if any one of the conditions imposed during later checks carried out by the control unit 36 is not met. The washing which is unwashed or which has been washed in an unsatisfactory manner is then unloaded into the contaminated room 18 through the door 12 and the defective part of the machine 10 is repaired.

When the control unit 36 detects the arrival of the desired minimum quantity of water in the tank 22, it carries out the following check. In the preferred embodiment described, this check consists of a check on the rotation of the drum 24 of the machine. More precisely, the control unit 36 checks that the drum 24 is turning properly at the desired speed, capable of ensuring efficient mixing of the water bath contained in the tank.

However, it should be noted that the check on the rotation of the drum is optional. Indeed, the personnel can easily themselves detect non-rotation of the drum without it being necessary to have a particular control available. Furthermore, non-rotation of the drum in the absence of other faults is extremely rare.

When the result of the preceding check is positive, the control unit 36 passes to the following step, in the course of which the presence of detergent products in the tank 22 of the machine is checked. This check is essential since the presence of detergent products is essential to obtaining the desired conditions of asepsis of the washing.

When the presence of the detergent products in the tank of the machine is assured, the control unit 36 carries out the following check. This check consists of verifying that a minimum temperature has been reached by the water bath which is then contained in the tank 22 of the machine. By way of illustration, at this stage one is able to verify that the temperature of the water bath has reached a value greater than or equal to about 60° C.

As soon as this minimum temperature is reached, the control unit 36 triggers a time measuring system, in such a way that a signal authorizing the opening of the unloading door 14 is emitted as soon as a predetermined period of time has passed since the previously mentioned minimum temperature was reached. By way of an example, which is in no way limitative, this predetermined time interval may be about 20 minutes.

The signal authorizing the opening of the door 14, delivered by the control unit 36 is transmitted to the unlocking command system 34. Consequently, as soon as the programmable controller 26 controlling the washing machine 10 emits a command signal for opening the door 14, the door is opened automatically by the unlocking command system 34.

On the other hand, if the signal authorizing the opening of the door 14 is not delivered by the control unit 36, because any one of the conditions successively checked by this unit has not been satisfied, the command emitted by the programmable controller 26 has no effect on the unlocking command system 34 and the door 14 remains locked. One may then be certain that the clean room 20 is never brought into contact with washing which does not satisfy the asepsis conditions.

In practice, the first check carried out by the control unit 36, which relates to the arrival of a minimum quantity of water in the tank 22 of the machine, can be carried out by using any type of sensor capable of emitting a signal representative of this quantity of water, such as a flow meter 38 installed in the water injection pipe 28, a sensor capable of measuring the volume or the mass of water injected into the tank 22, or a detector capable of measuring the level of water in this tank. The signal supplied by the sensor is transmitted to the control unit 36, in which it is compared with a predetermined threshold.

When afterwards, a check on the rotation of the drum 24 of the machine is carried out, this check can, in particular, be carried out by means of a speed detector installed in the tank 22 or on the mechanism which commands its rotation. The signal delivered by this detector is also transmitted to the control unit 36, in which it is compared to a predetermined threshold.

Furthermore, the check on the presence of detergent products in the tank 22 of the machine is advantageously carried out by means of the signal supplied by a sensor placed in the tank 22 and capable of measuring the pH of the bath. Hence, by way of an example, the measurement of a pH greater than or equal to 9 can be considered as being related to the introduction of an adequate quantity of detergent products into the tank.

Alternatively, it is also possible to carry out this check using a sensor placed in the tank 22 and capable of measuring the alkalinity or total hardness Th of the water bath. Another solution consists of checking the passage of the detergent products in the pipe 30 through which these products are injected into the tank 22. In all cases, the signal supplied by the sensor is transmitted to the control unit 36, where it is compared with a predetermined threshold.

In order to measure the temperature of the water bath, one or more temperature probes are installed in the tank 10. This probe may be the one normally fitted to the machine 10 or an additional probe independent of the existing probe. Again, the signal supplied by the probe is transmitted by the control unit 36, which compares it to a predetermined threshold.

Finally, the measurement of the time from the moment when the water bath reaches a minimum temperature can be carried out with the aid of any suitable means such as a timer or a clock integrated with the control unit 36 or outside it. Any other system of measuring the time can however be used, without departing from the scope of the invention. When the predetermined period of time has passed, the control unit 36 emits the signal authorizing the opening of the unloading door 14.

It should be noted that, in addition to its essential function of checking the aseptic nature of the washing on which the opening of the unloading door 14 is conditional, the control unit 36 can also be used to record the operational history of the machine 10. In effect, the results of the various checks carried out by this unit 36 over the course of time can be stored in a memory and/or transmitted in real time, to a device such as a printer connected to said control unit.

As has already been observed, the checking method according to the invention is not restricted to a machine fitted with several doors opening into separate rooms. In effect, this method can also be applied to machines with a single door, particularly when such machines are integrated into installations that permit the door to open into a contaminated room when loading and into a clean room when unloading. In this case, the single door of the washing machine can be fitted with an emergency system that enables it exceptionally to be opened only into the contaminated room when the signal authorizing opening of said door has not been emitted by the control unit.

What is claimed is:

1. Method of checking an aseptic nature of a washing prior to opening at least one door of a washing machine, said method comprising, in order, the following successive steps:

checking for an arrival of a minimum quantity of water in a tank of the machine;

checking for a presence of detergent products in said tank;

verifying that a minimum temperature is achieved by the water contained in said tank;

emission of a signal authorizing the opening of said door, a predetermined interval of time after obtaining said minimum temperature in said tank.

2. Method according to claim 1, in which the check on the arrival of said minimum quantity is followed by a check of rotation of a drum of the machine.

3. Method according to claim 1, in which the washing machine is integrated into a sealed partition separating a contaminated room from a clean room and has at least one door opening into each of said rooms, and in which each door opening into the clean room is locked in a closed condition, until the emission of said opening authorization signal.

4. Method according to claim 1, in which the arrival of said quantity of water is checked by using at least one of the techniques consisting of measuring a flow rate of the water admitted to the tank, measuring a volume of water admitted to the tank, measuring a mass of water admitted to the tank and measuring a height of water in the tank.

5. Method according to claim 1, in which the presence of detergent products is checked by using at least one of the techniques consisting of measuring a pH of the water contained in the tank, measuring the total hardness of said water and of checking an arrival of the detergent products in the tank.

6. Method according to claim 5, in which one verifies that the pH of the water contained in the tank is at least about 9.

7. Method according to claim 1, in which one verifies that the water reaches a minimum temperature of at least about 60° C.

8. Method according to claim 1, in which the signal for opening the door is emitted about 20 minutes after said minimum temperature has been obtained.

* * * * *

UNITED STATES PATENT AND TRADEMARK OFFICE

CERTIFICATE OF CORRECTION

PATENT NO. : 6,523,204 B1
DATED : February 25, 2003
INVENTOR(S) : Maziere et al.

It is certified that error appears in the above-identified patent and that said Letters Patent is hereby corrected as shown below:

Title page,
Item [75], Inventors, please delete “les Landes”, and insert therefor -- Les Vaudes --.
Item [73], Assignee, please delete “de”, and insert therefor -- De --.

Column 1,
Line 5, please insert the header -- DESCRIPTION --.
Line 67, after “of”, please insert -- a --.

Column 2,
Line 2, please delete “hat”, and insert therefor -- that --.

Signed and Sealed this

Twenty-first Day of October, 2003

JAMES E. ROGAN
*Director of the United States Patent and Trademark Office*